US008499850B2

(12) United States Patent
Hofbrucker et al.

(10) Patent No.: US 8,499,850 B2
(45) Date of Patent: Aug. 6, 2013

(54) SCREWDRIVING POWER TOOL WITH AN AXIALLY OPERATED PERCUSSION MECHANISM

(75) Inventors: Thomas Hofbrucker, Mammendorf (DE); Thomas Bader, Landsberg (DE); Markus Looser, S. Links (DE); Horst Rahmsdorf, Munich (DE)

(73) Assignee: Hilti Aktiengesellschaft, Schaan (LI)

( * ) Notice: Subject to any disclaimer, the term of this patent is extended or adjusted under 35 U.S.C. 154(b) by 2101 days.

(21) Appl. No.: 11/220,750

(22) Filed: Sep. 6, 2005

(65) Prior Publication Data

US 2006/0048956 A1 Mar. 9, 2006

(30) Foreign Application Priority Data

Sep. 6, 2004 (DE) ..... 10 2004 042 952

(51) Int. Cl.
*E02D 7/06* (2006.01)

(52) U.S. Cl.
USPC ..... 173/48; 173/178; 81/475

(58) Field of Classification Search
USPC ..... 173/48, 114, 117, 178, 201; 81/464, 81/474, 475
See application file for complete search history.

(56) References Cited

U.S. PATENT DOCUMENTS 3,616,883 A * 11/1971 Sindelar ..... 192/56.61
3,934,629 A 1/1976 Boman
5,094,133 A 3/1992 Schreiber
5,350,026 A * 9/1994 Markus et al. ..... 173/178
5,673,758 A * 10/1997 Sasaki et al. ..... 173/178
5,775,186 A * 7/1998 Rahm ..... 81/474
5,778,989 A * 7/1998 Neumaier ..... 173/178
6,035,945 A 3/2000 Tchijyou
6,109,149 A 8/2000 Neumaier
6,526,852 B2 * 3/2003 Rahmsdorf et al. ..... 81/464
2002/0002883 A1 1/2002 Rahmsdorf et al.

FOREIGN PATENT DOCUMENTS

CH 0278062 12/1951
DE 3804414 8/1989
DE 3832202 3/1990

OTHER PUBLICATIONS

Search Report.

* cited by examiner

*Primary Examiner* — Alexandra Elve
*Assistant Examiner* — Nathaniel Chukwurah
(74) *Attorney, Agent, or Firm* — Abelman, Frayne & Schwab

(57) ABSTRACT

The screwdriving power tool includes a hollow spindle (8) rotatably supported in the tool housing (4) and driven by a motor (26), a clutch (30) that rotatably connects and disconnects the hollow spindle (8) with and from the motor (26), respectively, in engagement and disengagement positions of the clutch (30), a screwing-in spindle (6) connected with a chuck (10) for a working tool (12) and connected with the hollow spindle (8) for a joint rotation therewith and for an axial displacement relative thereto, and a percussion mechanism (14) for applying a pulsed axial force to the screwing-in spindle (6), with the clutch (30) being brought into its engagement position by the screwing-in spindle (6) by being displaced against a biasing force of the clutch springs (40, 44), and being locked in its engagement position.

10 Claims, 3 Drawing Sheets

SCREWDRIVING POWER TOOL WITH AN AXIALLY OPERATED PERCUSSION MECHANISM

BACKGROUND OF THE INVENTION

1. Field of the Invention

The present invention relates to a screwdriving power tool including a housing, a hollow spindle rotatably supported in the housing and driven by a motor, in particular by an electric motor. The screwdriving power tool further includes a clutch rotationally connecting, in its engagement position, the hollow spindle with the motor, and rotationally disconnecting the hollow spindle from the motor in its disengagement position, with the clutch including clutch spring means for preloading the clutch in the disengagement position.

The screwdriving power tool also includes a screwing-in spindle connected, for joint rotation therewith, with a chuck for receiving a working tool, and connected with the hollow spindle for a joint rotation therewith and for an axial displacement relative thereto, with the clutch being brought into the engagement position thereof by the displacement of the screwing-in spindle against a biasing force of the clutch springs. A percussion mechanism applies a pulsed axial force to the screwing-in spindle.

2. Description of the Prior Art

In screwdriving power tools of the type described above, during screwing-in of a fastening element, the screwing-in spindle can be displaced by the axial percussion mechanism in a pulsed manner. Thereby, e.g., a quick-action constructional screw can be screwed in, upon attachment of a constructional element formed of a soft material such as, e.g., gypsum plaster board to a metal frame after piercing the soft material, without pressing the screwdriving power tool against the hard metal frame too hard. During the screw-in process, the axial forces, which are generated by the axial percussion mechanism and which act as pressing forces, are completely sufficient for screwing a screw in metal.

German Publication DE 100 32 949 discloses a screwdriving power tool with an axial percussion mechanism that applies pulsed axial forces to a screwing-in spindle. The screwing-in spindle is retained in a hollow spindle with a possibility of a limited axial displacement by ball-shaped locking members. The ball-shaped locking members are pivotally arranged in radial receiving bores formed in the hollow spindle and permanently project in axially extending grooves formed in the outer surface of the screwing-in spindle. For transmission of the rotational movement, the screwing-in spindle should be displaced relative to the tool housing in the direction opposite the screw-in direction by pressing of the screwdriving power tool against the to-be-attached workpiece. The hollow spindle is displaced, at a certain point of the screwing-in spindle displacement, together therewith until a clutch member, which is supported on the hollow spindle, engages a clutch member fixedly secured relative to the housing.

This construction permits to produce a compact screwdriving power tool with which a good quality of a screw connection is achieved at reduced press-on forces.

However, during an operation of a known screwdriving power tool, it may occur that an axial displacement of the screwing-in spindle in the screw-in direction effected with the axial percussion mechanism, may cause a momentary disengagement of the clutch. This can result in a smaller work progress, on one hand, and in an increased wear, on the other hand. In addition, the displaceable support of the screwing-in spindle makes the insertion and removal of the working tool in and out of the chuck, respectively, more difficult.

Accordingly, an object of the present invention is to provide a screwdriving power tool with an axial percussion mechanism in which the foregoing drawbacks of the known screwdriving power tool are eliminated and which can be easily handled.

Another object of the present invention is to provide a screwdriving power tool of the type described above which would have an extended service life.

SUMMARY OF THE INVENTION

These and other objects of the present invention, which will become apparent hereinafter, are achieved by locking the clutch in its engagement position.

With the clutch being locked in its engagement position, the clutch engagement is insured to a most possible extent independent on the position of the screwing-in spindle. Thus, a torque can be transmitted to the screwing-in spindle from the drive over the clutch and the hollow spindle even when the screwing-in spindle is releasably arranged in the screw-in direction. In this way, the disengagement of the clutch resulting from the axial displacement of the screwing-in spindle by the axial percussion mechanism, is prevented. The prevention of the clutch disengagement reduces the clutch wear.

Advantageously, a locking mechanism is provided for locking the clutch and which is actuated dependent on the position of the screwing-in spindle relative to the hollow spindle. This provides for automatic actuation and deactuation of the locking mechanism.

Advantageously, the clutch has a movable clutch member which is fixedly secured relative to the housing by the locking mechanism in the engagement position of the clutch. With the movable clutch member being fixedly secured relative to the housing, the clutch can be held particularly stably in its engagement position, and an inadvertent displacement of the clutch to its disengagement position is thereby prevented.

According to a particularly advantageous embodiment of the present invention, the screwing-in spindle is fixedly secured relative to the hollow spindle of the locking mechanism in the release position of the clutch. This substantially simplifies insertion of the working tool in the chuck and its removal therefrom. This is because the screwing-in spindle does not move axially.

Advantageously, the locking mechanism has at least one locking member displaceable in radial cross-bore formed in hollow spindle between an engagement position in which it partially extends in the longitudinal bore formed in the hollow spindle, and a release position in which it is located outside of the longitudinal bore of the hollow spindle. Thereby, with small manufacturing costs, a releasable connection of the hollow spindle with the screwing-in spindle displaceable in the longitudinal bore of the hollow spindle, is obtained.

It is beneficial when the screwing-in spindle is provided with a recess an axial extent of which is adapted to a portion of the locking member extending into the longitudinal bore of the hollow spindle. Thereby, the screwing-in spindle can be secured to the hollow spindle backlash-free in the axial direction.

It is advantageous when the recess is formed as an annular groove, which further reduces manufacturing costs.

Advantageously, the movable clutch member is fixedly connected with the hollow spindle. The housing is provided with an axial stop which the at least one locking member engages in the release position of the clutch. Thereby, the movable clutch member can be supported against the housing by the hollow spindle and the released hollow member against the biasing force of the clutch spindle. This insures a stable engagement of the clutch.

It is further advantageous when the locking member is ball-shaped, which insures an easy displacement of the locking member between its engagement and release position, without any jamming.

Advantageously, the axial stop is formed by a circumferential shoulder provided on a guide sleeve. Thereby, the axial stop can be formed, separately from the housing, of a particular hard material, which increases the service life of the screwdriving power tool.

The novel features of the present invention, which are considered as characteristic for the invention, are set forth in the appended claims. The invention itself, however, both as to its construction and its mode of operation, together with additional advantages and objects thereof, will be best understood form the following detailed description of preferred embodiment, when read with reference to the accompanying drawings.

DETAILED DESCRIPTION OF THE PREFERRED EMBODIMENT

Figure 1:
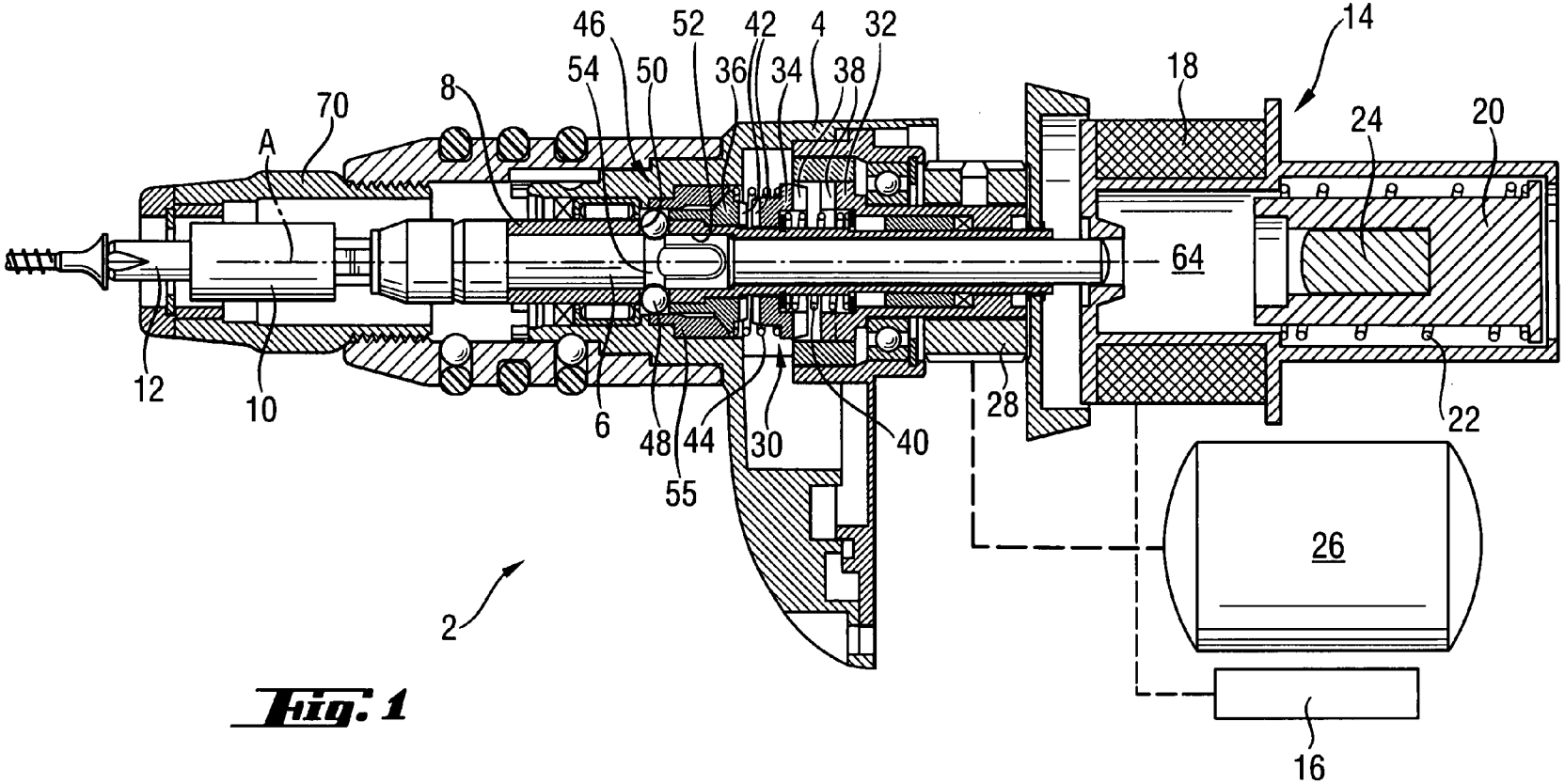
FIG. 1 a side, partially cross-sectional view of a front portion of a screwdriving power tool according to the present invention, before the start of a screwing-in process.

An electrically driven, hand-held, screwdriving power tool 2 according to the present invention, a front portion of which is shown in FIG. 1, includes a housing 4 and a screwing-in spindle 6 which is supported in a hollow spindle 8 for a limited axial displacement along the axis A but which is connected to the hollow spindle 8 for joint rotation therewith. At the driving side end of the screwing-in spindle 6, there is provided a chuck 10 in form of a bit holder for releasably receiving a working tool 12, in particular, in form of a screwdriving bit.

At the end of the screwing-in spindle 6 remote from the driving side end thereof, there is provided, in the power tool 2, a percussion mechanism generally designated with a reference numeral 14. The percussion mechanism 14 essentially includes an electromagnet 18, actuation of which is controlled by a schematically shown, control unit 16, and an impact body 20 which is biased to its initial position by a return spring 22, with the impact body 20 being substantially located, outside of the electromagnet 18, in the interior of the return spring 22.

In the axial extension of the screwing-in spindle 6, the impact body 20 has a hardened insert 24 that applies pulsed axial forces to the driven end of the screwing-in spindle 6. To this end, the coil of the electrical magnet 18, not shown in detail, is supplied with a predetermined voltage for a predetermined time period by the control until 16. The produced magnetic force accelerates the magnetizable impact body 20 in a direction of the screwing-in spindle 6 against the biasing force of the return spring 22. In this way, pulsed axial blows, which are applied to the driven side end of the screwing-in spindle 6, are generated. The control unit can be formed, e.g., as a switch or as a sensor-controlled electronics.

For applying a torque to the screwing-in spindle 6, the screwdriving power tool 2 has an electric motor 26 which is connected, in a manner not shown in detail, with a drive gear 28 formed as a tooth belt disc. The drive gear 28 is connected with a first clutch member 32 of a clutch 30 for joint rotation therewith. The first clutch member 32 is rotatably supported on the hollow spindle 8. A second clutch member 34 of the clutch 30 is supported on the hollow spindle 8 for a free rotation thereabout and for an axial displacement therealong. The third clutch member 36 is fixedly connected with the hollow spindle 8.

The first clutch member 32 and the second clutch member 34 are preloaded in a spaced position thereof, which is shown in FIG. 1, with a first clutch spring 40. In the spaced position of the first and second clutch members 32 and 34, cam-shaped first engagement elements 38, which are provided thereon, are spaced from each other.

The second clutch member 34 and the third clutch member 36 are preloaded in a spaced position thereof, with a second clutch spring 44. in the spaced position of the second and third clutch members 34 and 36, cam-shaped second engagement elements 42, which are provided thereon, are spaced from each other.

Upon displacement of the hollow spindle 8, the clutch 30 is brought into an engagement position, in which the first and second engagement elements 38 and 42 are in their respective engagement positions, as it would be discussed further below.

The screwdriving power tool 2 further includes a locking mechanism which is generally designated with a reference numeral 46. The locking mechanism 46 has two ball-shaped locking members 48 which are arranged in opposite radial cross-bores 50 with a possibility of radial displacement therein.

In the initial position of the screwdriving power tool 2, which is shown in FIG. 1, the locking members 48 partially project in the longitudinal bore 52 of the hollow-shaped recess 54 which is adapted to the shape of the locking members 48 and is formed in the screwing-in spindle 6. At a side remote from the screwing-in spindle 6, the locking members 48 are supported against inner surface of a guide sleeve 55 which is fixedly secured in the housing 4 and through which the hollow spindle 8 extends. The guide sleeve 55 prevents radial displacement of the locking members 48 relative to the longitudinal bore 52 in the engagement position shown in FIG. 1.

The locking members 48 axially secure the screwing-in spindle 6 relative to the hollow spindle 8. The locking members 48, and thereby the screwing-in spindle 6, are secured relative to the housing 4 by the clutch springs 40, 44 in the position shown in the drawings. With the screwing-in spindle 6 being secured relative to the housing 4, a working tool 12 can be easily inserted into the chuck 10 or removed therefrom.

Figure 2:
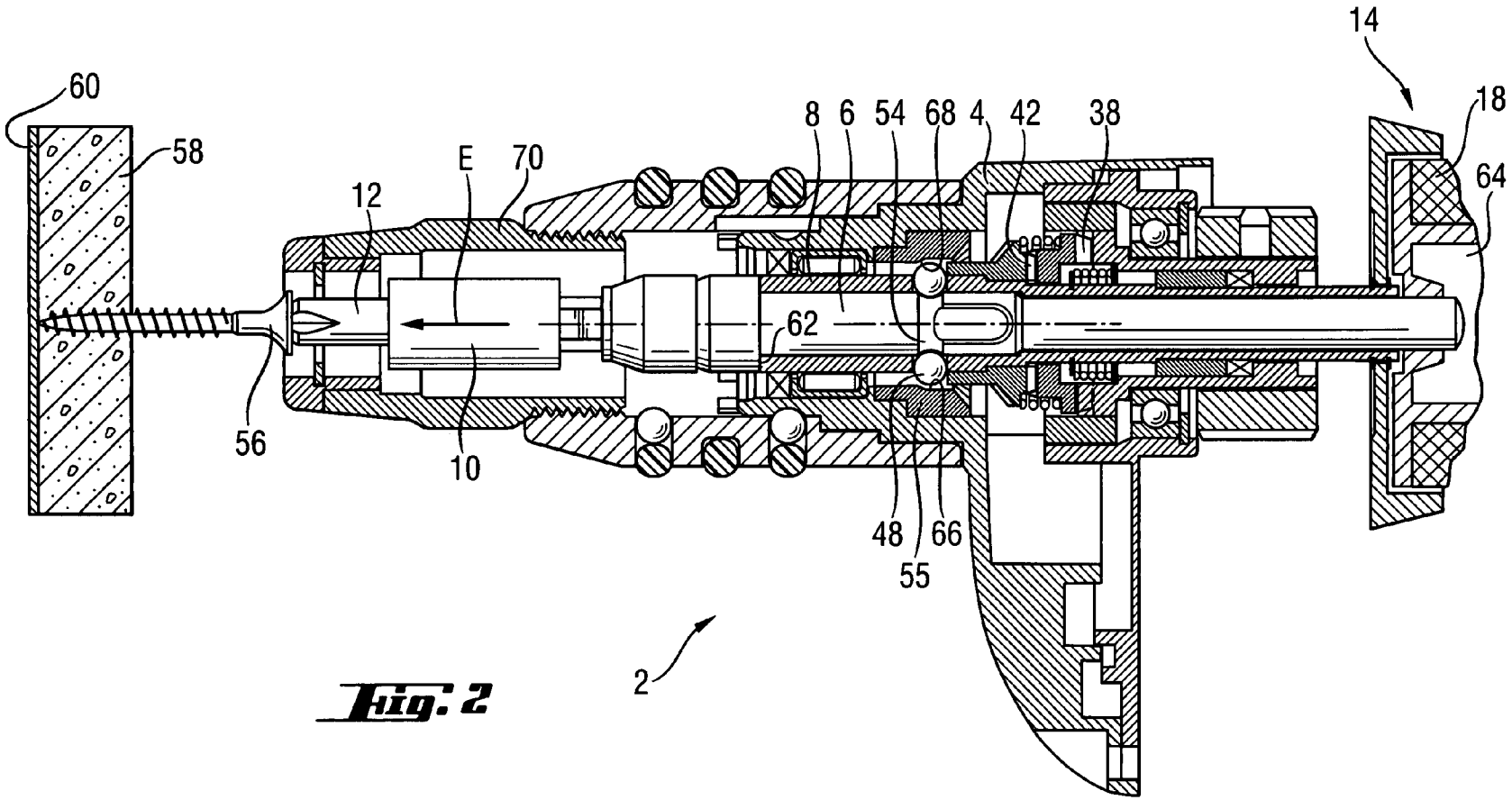
FIG. 2 a side, partially cross-sectional view of a front portion of the screwdriving power tool shown in FIG. 1 during a process of screwing a fastening element in a component formed of a hard material.

FIG. 2, as it has already been discussed above, show the screwdriving power tool 2 in a process of screwing-in a fastening element 56 in the form of a quick-acting constructional screw for securing a soft constructional element 58 in form of a gypsum plaster board to a hard constructional component 60 in form of a metal frame.

In the position shown in FIG. 2, in response to an operator pressing the screwdriving tool 2 in a direction toward the constructional component 60, the fastening element 56, which is being pressed with the screwdriving power tool 2 against the constructional component 60, applies a counter-pressure to the screwing-in spindle 6 via the working tool 12 and the chuck 10. This counter-pressure is imparted to the driving side end of the hollow spindle 8 via the shoulder 62. As a result, the hollow spindle 8 is displaced, together with the screwing-in spindle 6, relative to the housing 4 in a direction opposite the screw-in direction E which is shown with an arrow. As a result of this displacement, the clutch 30 is displaced in its engagement position in which both the first engagement elements 38 and the second engagement elements 42 become engaged.

Upon the displacement of the hollow spindle 8 and the screwing-in spindle 6 relative to the housing 4, the locking members 48 are displaced, in the axial direction, relative to the guide sleeve 55 which is fixedly secured to the housing, and are located at a height of an expansion section 66 of the guide sleeve 55. In the region of the expansion section 66, the locking members 48 can now be radially displaced between the inner surface of the guide sleeve 55 and the recess 54.

Simultaneously, the driven side end of the screwing-in spindle 6 is displaced into an impact space 64 that is formed by the electromagnet 18. Upon actuation of the percussion mechanism 14, the hardened insert 24 impacts the end of the screwing-in spindle 6 that projects into the impact space 64, whereby the screwing-in spindle 6 is imparted with a pulsed axial force acting in the screwing-in direction E. As a result of the blows imparted to the screwing-in spindle 6, the spindle 6 drives the fastening element 56 through the hard constructional element 60, as shown in FIG. 3.

Figure 3:
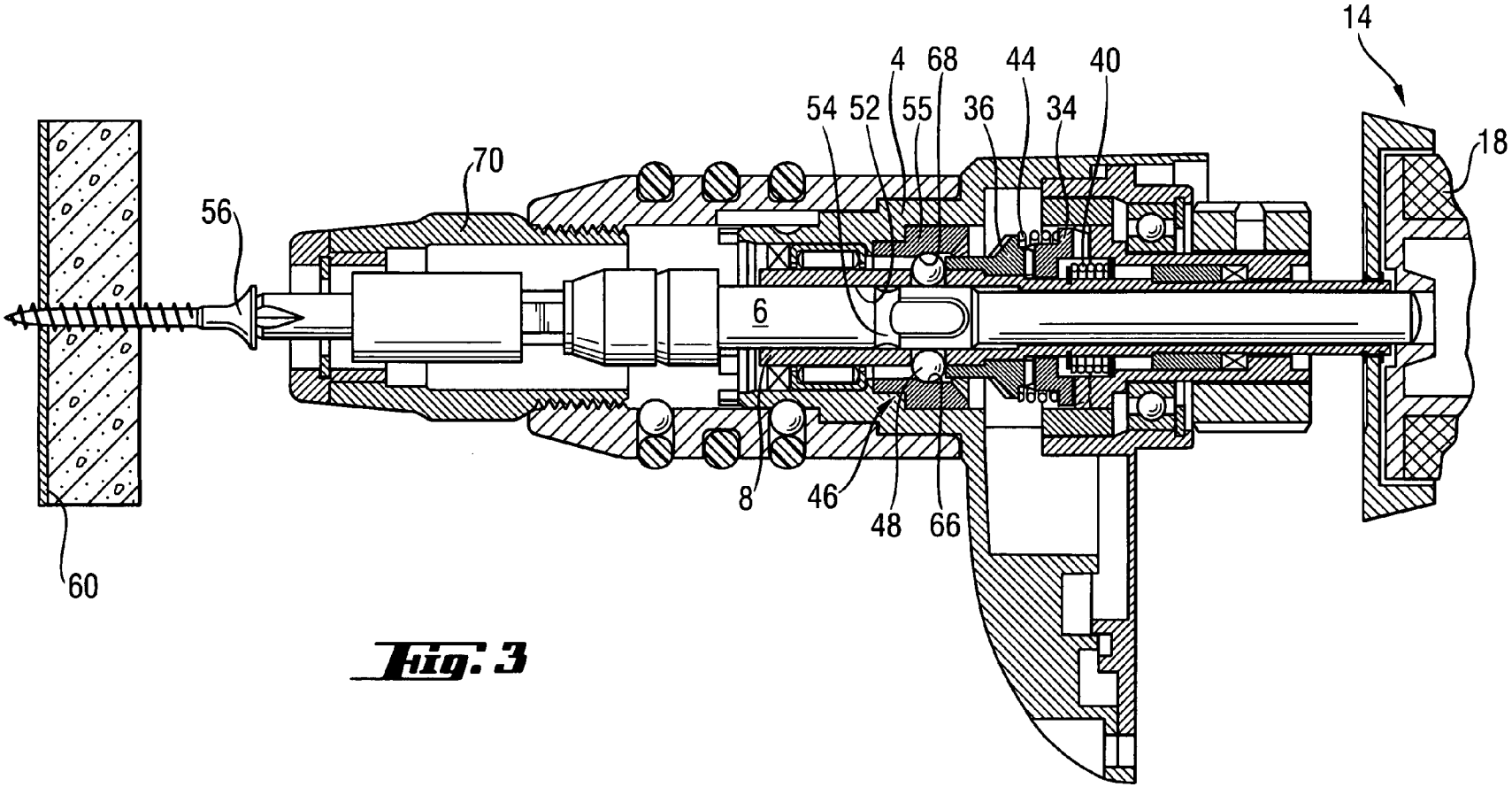
FIG. 3 a side, partially cross-sectional view of a front portion of the screwdriving power tool shown in FIG. 2 immediately after the fastening element pierced the hard material component.

As further shown in FIG. 3, as a result of displacement of the screwing-in spindle 6 relative to the hollow spindle 8, the locking members 48 are displaced out of the recess 54 into a disengaged position in which they do not project anymore into the longitudinal bore 52 of the hollow spindle 8. Rather, the locking members 48 are located in the region of the expansion section 66 formed in the inner surface of the guide sleeve 55. Thus, the screwing-in spindle 6 is only rotationally connected with the hollow spindle 8, with the axial connection being lifted.

Simultaneously, the locking members 48 engage, in their release position, a shoulder 68 of the guide sleeve 55 that limits the expansion section 66 axially. As a result, the second clutch member 34 and the third clutch member 36 are supported against the housing 4 against the biasing force of the clutch springs 40 and 44 through the locking members 48 and the guide sleeve 55, which is fixedly secured to the housing 4. in this way, the locking mechanism 46 locks the clutch 30 in its engagement position in the position shown in FIG. 3 immediately after the screwing-in spindle 6 was impacted by the percussion mechanism 14. This insures a reliable torque transmission from the motor 26 over the clutch 3 to the hollow spindle 8 and the screwing-in spindle 6.

After the screwdriving power tool 2 is displaced by the operator relative to the screwing-in spindle, which was accelerated in the screw-in direction E, the locking members 48 again arrives at the height of the recess 54 at which the locking members 48 can be displaced radially inward, and the biasing forces of the clutch 30 are again propped by the hard constructional component 60 according to FIG. 2.

When a screw-in depth, which is set with a depth stop 70, is reached, the hollow spindle 8 is displaced in the screw-in direction E by the clutch springs 40 and 44. With this, the locking members 48 are displaced by the shoulder 68 in the region of the guide sleeve 55 outside of the expansion region 66, where the locking members 48 are located, without a possibility of radial displacement, between the inner surface of the guide sleeve 55 and the screwing-in spindle 6, and the screwdriving power tool 2 again occupies its initial position shown in FIG. 1.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A screwdriving power tool (2), comprising:

a housing (4);

a hollow spindle (8) rotatably supported in the housing (4);

a motor (26) for driving the hollow spindle (8);

a clutch (30) rotationally connecting, in an engagement position thereof, the hollow spindle (8) with the motor, and rotationally disconnecting the hollow spindle (8) from the motor (26) in a disengagement position thereof, the clutch (30) including clutch spring means (40, 44) for preloading the clutch in a disengagement position thereof;

a screwing-in spindle (6) connected, for joint rotation therewith, with a chuck (10) for receiving a working tool (12), and connected with the hollow spindle (8) for a joint rotation therewith and for an axial displacement relative thereto, the clutch (30) being brought into the engagement position thereof by displacement of the screwing-in spindle (6) against a biasing force of the clutch springs (40, 44);

a percussion mechanism (14) for applying a pulsed axial force to the screwing-in spindle (6); and means for locking the clutch (30) in the engagement position thereof, and for retaining the clutch (30) in a locked condition while applying said pulsed axial force to the screwing-in spindle (6).

2. A screwdriving power tool according to claim 1, wherein the locking means comprises a locking mechanism (46) actuatable dependent on a position of the screwing-in spindle (6) relative to the hollow spindle (8).

3. A screwdriving power tool according to claim 2, wherein the clutch (30) comprises a movable clutch member (34, 36) which is fixedly secured relative to the housing (4) in the engagement position of the clutch (30) by the locking mechanism (46).

4. A screwdriving power tool according to claim 3, wherein the locking mechanism (46) has at least one locking member (48) displaceable in radial cross-bore (50) formed in hollow spindle (8) between an engagement position in which it partially extends in the longitudinal bore (52) formed in the hollow spindle (8), and a release position in which it is located outside of the longitudinal bore (52) of the hollow spindle (8).

5. A screwdriving power tool according to claim 4, wherein the screwing-in spindle (6) has a recess (54) an axial extent of which is adapted to a portion of the locking member (48) that extends in the longitudinal bore (52) of the hollow spindle (8).

6. A screwdriving power tool according to claim 5, wherein the recess (54) is formed as an annular groove.

7. A screwdriving power tool according to claim 4, wherein the movable clutch member (34, 36) is fixedly connected with the hollow spindle (8), and wherein the housing (4) is provided with an axial stop which the at least one locking member (48) engages in the release position of the clutch (30).

8. A screwdriving power tool according to claim 7, wherein the axial stop is formed by a circumferential shoulder (68) provided on a guide sleeve (55).

9. A screwdriving power tool according to claim 4, wherein the at least one locking member (48) is ball-shaped.

10. A screwdriving power tool according to claim 2, wherein the screwing-in spindle (6) is fixedly secured relative to the hollow spindle (8) in the release position of the clutch (30) by the locking mechanism (46).

* * * * *